United States Patent [19]

Proudhon

[11] Patent Number: 4,813,900

[45] Date of Patent: Mar. 21, 1989

[54] DEVICE FOR THE INSERTION OF CATHODES IN CATHODE TUBE GUNS, ESPECIALLY FOR THE SIMULTANEOUS INSERTION OF THE THREE CATHODES OF A TRICHROMATIC TUBE

[75] Inventor: Gérard Proudhon, Venissieux, France

[73] Assignee: Videocolor, Montrouge, France

[21] Appl. No.: 169,954

[22] Filed: Mar. 18, 1988

[30] Foreign Application Priority Data

Mar. 20, 1987 [FR] France ..... 87 03924

[51] Int. Cl.[4] ..... H01J 9/06

[52] U.S. Cl. ..... 445/67; 445/36

[58] Field of Search ..... 445/67, 36, 34

[56] References Cited

U.S. PATENT DOCUMENTS

| | | | |
|---|---|---|---|
| 3,533,147 | 10/1970 | Baur et al. | 445/34 |
| 4,015,315 | 4/1977 | Stone | 445/34 |
| 4,449,951 | 5/1984 | Nill | 445/36 X |

*Primary Examiner*—Kenneth J. Ramsey

*Attorney, Agent, or Firm*—Oblon, Fisher, Spivak, McClelland & Maier

[57] ABSTRACT

The insertion device of the invention comprises an insertion rod. The external diameter of the front end of this insertion rod is greater than the diameter of the body. This rod is hinged, as if pivoted, on its actuating support.

4 Claims, 2 Drawing Sheets

DEVICE FOR THE INSERTION OF CATHODES IN CATHODE TUBE GUNS, ESPECIALLY FOR THE SIMULTANEOUS INSERTION OF THE THREE CATHODES OF A TRICHROMATIC TUBE

BACKGROUND OF THE INVENTION

1. Field of the Invention

The present invention relates to a device for the insertion of cathodes in cathode tube guns, and especially for the simultaneous insertion of the three cathodes of a trichromatic tube.

2. Description of the Prior Art

One technique for fixing cathodes in cathode tube electron guns consists in the use of substantially sleeve-shaped "eyelets" which flare out on one side. The flared out part ends in a ring which is fixed to a supporting electrode placed just behind the first grid of the gun. The cathode is inserted in this eyelet and can move freely in it. This cathode is held at the end of a hollow rod (hereinafter called an insertion rod) connected to a vacuum tap. When the distance between the active side of the cathode and the first or second grid is adjusted to the desired value, the cathode is welded into the eyelet generally by spot or laser welding, at three or four spots.

However, despite all the care that may be taken in fixing eyelets, it often happens that these eyelets have position defects such as translational dislocations or tilts with respect to the theoretical axis. Faults of this type are detrimental to the proper positioning of the cathodes and to their adjustment, and entail the risk of damaging them when they are inserted in the eyelets or when the positioning instruments are withdrawn.

An object of the present invention is a device used to compensate for defects in the positioning and alignment of the three cathode eyelets of an electron gun cathode during the automatic positioning of the cathodes in the eyelets. This device should also enable the front-to-rear movement of the cathode in the eyelet in order to adjust the difference between the cathode and the first grid of the gun practically without any gap between the cathode and its eyelet, and should achieve this result during the simultaneous insertion of the three cathodes of a trichromatic tube.

SUMMARY OF THE INVENTION

The insertion device according to the invention has at least one hollow cylindrical "insertion rod", one end of which is designed to take the cathode to be inserted, which is held in position at this end by suction. The other end of the rod, held by this same suction, is connected to a support that is movable in a direction parallel to the axis of the gun in the eyelet of which a cathode has to be inserted. According to a characteristic of the invention, the external diameter of the front end of the rod is, from the front side of this end, substantially equal, along a short length, to the internal diameter of the cathode body, and then, along a length at least equal to about the length of the cathode, smaller than the said internal diameter. Advantageously, the transition between these two parts, with different diameters of the insertion rod is conical, with an angle of about 20° maximum at the center.

According to another characteristic of the invention, the end of the insertion rod, which is connected to a movable support, is hinged on it as if with a pivot.

BRIEF DESCRIPTION OF THE DRAWINGS

The present invention will be better understood from the following detailed description of an embodiment, taken as a non-restrictive example and illustrated by the appended drawings, of which.

DESCRIPTION OF A PREFERRED EMBODIMENT

Figure 1:
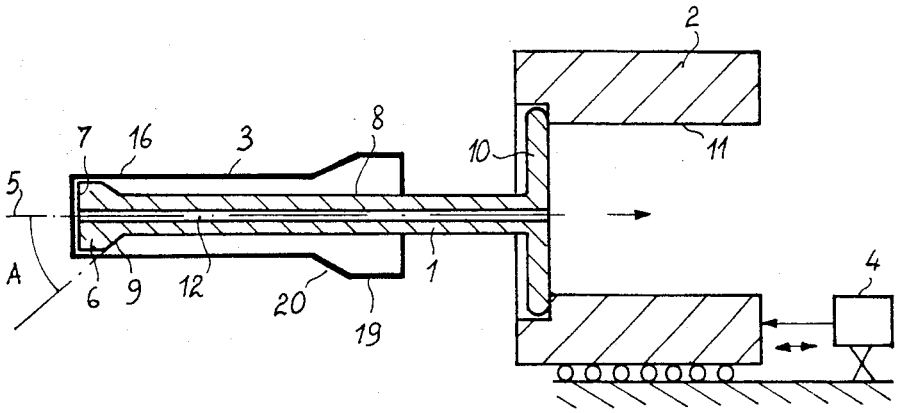
FIG. 1 is a simplified sectional view of a cathode insertion device according to the invention.

The cathode insertion device shown in the drawing essentially comprises a tubular insertion rod 1 connected to a support 2 which is movable, through the action of a motor 4, along a direction parallel to the axis of the gun, in the eyelet of which this device has to insert a cathode 3 (of course when the gun is in insertion position). In FIG. 1, the rod 1 is shown in the idle position, i.e its longitudinal axis 5 is parallel to the direction in which the gun 13 moves. This idle position is maintained by suction or, for example, by means of springs (not shown).

The rod 1 has a general shape of a hollow cylinder with a circular section. Its free end 6 (the end which is not connected to the support 2) has, on a short length starting from its front side 7, for example on a length of about 0.5 to 1 mm., an external diameter which is practically equal to the minimum tolerated internal diameter of the cathodes which is, for example, 1.96 mm., so that the cathodes can be fitted over the rod 1 with mild friction in the most unfavorable conditions. The body 8 of the rod 1 has an external diameter (for example, 1.72 mm) which is smaller than that of the end 6 (1.96 mm. in the same example). The transition 9 between the end 6 and the body 8 is done conically with an angle at the center A of about 20° or less. The length of the body 8 is at least equal to about the length of the cathodes 3.

The body 8 of the rod 1 ends in a device 10 forming a a pivoting hinge in the support 2. This hinging is done by very mild friction, so that the rod 1 can be removed practically without effort from a cathode when the latter is welded into an eyelet, even if this eyelet is out of line (as shall be explained in greater detail below).

The support 2 also has a general shape of a hollow cylinder and is connected to a vacuum pump (not shown). The bore 11 of the body 2 communicates with the axial bore 12 of the rod 1. This bore 12 opens out onto the front side 7 so that when a cathode 3 is fitted over the rod 1, its back wall is firmly held against the side 7 of the rod 1 for as long as the vacuum pump is in communication with the support 2. Of course, the suction of this pump largely compensates for any leaks which may occur in the pivot 10.

The above-described device works as follows. With the device in the rear position, a gun (partially visible in FIGS. 2 and 3) without cathodes is set up. An automatic handling device (not shown) attaches a cathode to the rod 1. The vacuum pump is in permanent communication with the support 2. The cathode 3 is then held firmly on the rod 1 (FIG. 1).

Figure 2:
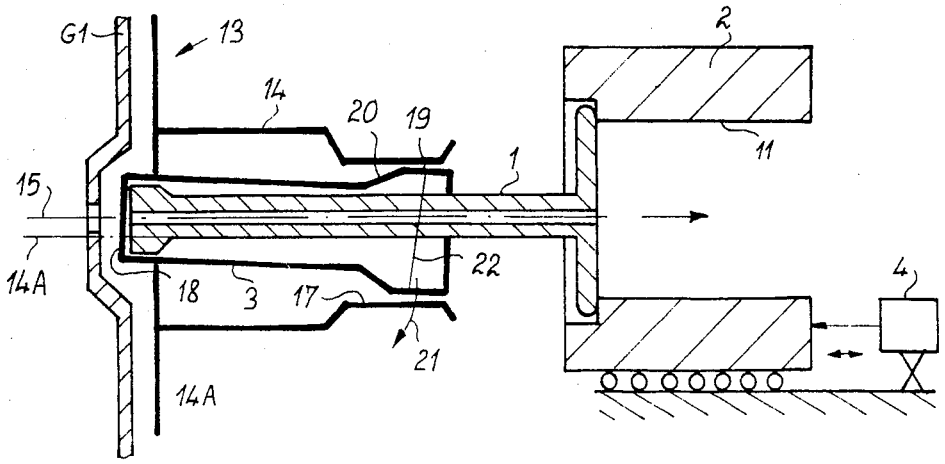
FIG. 2 is a view of the device of FIG. 1 during the positioning of a cathode in its eyelet.
Figure 3:
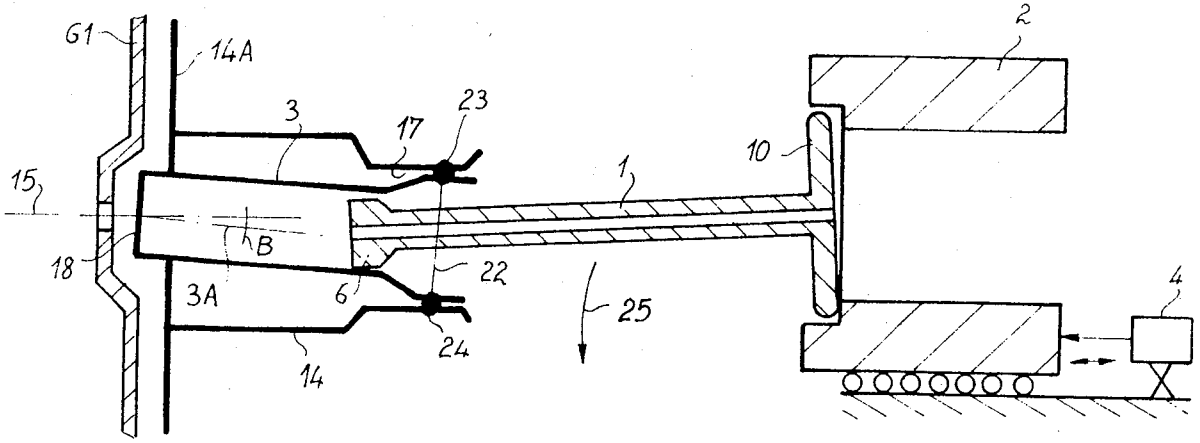
FIG. 3 is a view of the device of FIG. 1 when it is being withdrawn.

The gun 13 is brought forward towards the support 2 with the rod 1 still in the said idle position. It is assumed, as shown in FIGS. 2 and 3, that the axis **14*a* of the eyelet 14 in which the cathode 3 should be fixed is not indistinguishable from the axis 15 of the gun because it is difficult to keep within very strict tolerance limits when the eyelet 14 is being welded to its support 14a. With the rod 1 in idle position, its axis is indistinguishable from the axis 15. Since the external diameter of the front part 16 of the cathode 3 is smaller than the diameter of the opening 17 of the eyelet 14, this front part can penetrate the eyelet. It is assumed, of course, that the tolerated distance between the axes 15 and 14A is smaller than the difference between the internal radius of the opening 17 and the external radius of the part 16**, and that distances greater than this difference would cause the gun to be rejected.

After the eyelet is put on the cathode, and at a cathode-grid distance 1 greater than the desired distance, the motor 4 commands the support 2 to go forward until the distance between the emitting side 18 of the cathode 3 and the first grid Gl of the gun reaches the desired value (this distance between the cathode and Gl may, if necessary, be determined indirectly by measuring the distance between the cathode and the second grid in a manner known per se ).

The cathode 3 has a rear part 19, the external diameter of which is greater than the external diameter of its front part 16. The transition 20 between the parts 16 and 19 of the cathode 3 is conically shaped. The external diameter of the part 19 is slightly smaller than the internal diameter of the opening 17 of the eyelet 14.

During the motion of the gun 13 towards the cathode 3, its transition 20 rubs against the opening 17, thus making the cathode tilt (arrow 21)in a rotational movement around the end 6 of the rod 1. The length of this end 6 is very small (about 0.5 mm. as specified above) and this end 6 can therefore be likened to a pivot. Of course, the suction, or the springs in a similar device, which hold the rod 1 in its idle position, do not exert excessive force on the rod so that it can be easily controlled by light friction between the end 6 and the internal side of the cathode. Thus, when the cathode 3 is in position in the eyelet 14, the median circumference 22 of its rear part 19 is substantially concentric with the opening 17. The cathode can then be welded into the eyelet at this median circumferance 22, by laser, at two or four evenly spaced spots (spots 23, 24 in FIG. 3).

When this welding is completed, the gun 13 is withdrawn with the vacuum pump still connected. Since the axis 3A of the cathode 3, welded in the eyelet 14, makes an angle B with the axis 15, the rod 1 cannot be withdrawn without any damage unless it is pivoted (arrow 25) and this is possible through the pivot device 10 and through the fact that the end 6 of the rod has a short length and can be easily guided by the internal walls of the cathode. When the rod 1 leaves the cathode 3 by suction effect or spring effect, it straightens up and returns to the idle position.

It will be noted that the center of the emitting side 18 of the cathode 3 is practically on the axis 15 because, when it is positioned on the cathode, the rod 1 undergoes no tilt and its axis remains indistinguishable from the axis 15 until the welding is done (23, 24).

In view of the small dimensions of the support 2, and since any length may be chosen for the rod 1 provided that this length is greater than the length of a cathode and that the rod is sufficiently rigid, it is possible to place three devices, such as the one described above, side by side to insert all three cathodes of a triple trichromatic gun at the same time. Of course, the motors (such as the motor 4) used to activate the three rods are then controlled independently of one another.

What is claimed is:

1. A device for the insertion of cathodes in cathode tube guns, especially for the simultaneous insertion of the three cathodes of a trichromatic tube, comprising at least one hollow cylindrical "insertion rod", one end of which is designed to take the cathode to be inserted, which is held in position at this end by suction, the other end of the rod being connected to a support that is movable in a direction parallel to the axis of the gun in the eyelet of which a cathode has to be inserted, device wherein the external diameter of the front end of the rod is, from the front side of this end, substantially equal, along a short length, to the internal diameter of the cathode body, and then, along a length at least equal to about the length of the cathode, smaller than the said internal diameter.

2. An insertion device according to claim 1 wherein the said short length is about 0.5 to 1 mm.

3. A device according to claim 1 or 2 wherein the transition between the two parts, with different diameters, of the rod is conical with an angle of about 20° maximum at the center.

4. A device according to the claim 1 wherein the end of the insertion rod which is connected to a movable support is hinged with respect to this support as with a pivot.

* * * * *